US005636871A

United States Patent [19]

Field

[11] Patent Number: 5,636,871

[45] Date of Patent: Jun. 10, 1997

[54] PORTHOLE-SUSPENDED STORAGE BAG

[76] Inventor: Jean Field, 27 W. Hills Rd., Huntington Station, N.Y. 11746

[21] Appl. No.: 655,623

[22] Filed: May 30, 1996

[51] Int. Cl.[6] ..... B65D 33/14

[52] U.S. Cl. ..... 383/33; 114/361; 141/391; 220/404

[58] Field of Search ..... 383/33; 220/404; 141/372, 391; 114/361; 441/74; 4/484

[56] References Cited

U.S. PATENT DOCUMENTS

| | | | |
|---|---|---|---|
| 2,295,584 | 9/1942 | Larson | 383/33 X |
| 3,444,563 | 5/1969 | Gordon, Jr. | 4/484 |
| 3,817,434 | 6/1974 | Dickman | 383/33 X |
| 4,200,127 | 4/1980 | Dunleavy | 141/391 X |
| 5,082,219 | 1/1992 | Blair | 383/33 X |
| 5,478,152 | 12/1995 | Bogle | 383/33 |

*Primary Examiner*—Jes F. Pascua
*Attorney, Agent, or Firm*—Myron Amer P.C.

[57] ABSTRACT

A sailing boat storage bag with an opening sized to be suspending in depending relation within an inadvertently undersized opening of a porthole, the bag opening sizing being achieved using a bag-attached strip of a flexible rim with opposite ends configurated into a circle with the opposite ends bounding a clearance therebetween that reduces the oversize in the bag opening to match the undersized porthole opening, after which hook and loop patches hold the bag opening to the size-adjusted diameter which enables the bag to be suspended in the porthole.

2 Claims, 2 Drawing Sheets

PORTHOLE-SUSPENDED STORAGE BAG

The present invention relates generally to a storage bag accessory for a sailboat, and more particular to improvements for making diameter size adjustments in the storage bag opening to facilitate supporting the bag in depending relation from a selected porthole in the deck of the sailboat.

EXAMPLE OF THE PRIOR ART

U.S. Pat. No. 3,674,170 issued to David C. Thorpe et al. for "Storage Containers for Use in Marine Craft" on Jul. 4, 1972 is noted not for the disclosure of structural features pertinent to the within inventive storage bag, but rather for the practice of adapting marine structures having a primary utility to also serve a secondary utility of storage, since storage space is at a premium on marine craft.

It is advantageous to support a storage bag directly from within the confines of a deck porthole in depending relation therefrom so that the utility of the porthole in providing light and ventilation is extended to use of the storage bag, wherein the porthole opening provides access for sailing gear, food, trash and the like inserted through the porthole opening for storage in the bag. To serve this double function, the diameters of the porthole opening and of the storage bag opening must match, which often is not the case, since it more typically occurs that these diameters are slightly undersized or oversized in relation to each other. There are no known diameter-size adjustment means that can be used that will not interfere with the primary function of the porthole, and more particularly with closing the porthole incident to regulating light and ventilation therethrough.

Broadly, it is an object of the present invention to provide for a sailboat, in particular, an all-purpose storage bag presenting a storage compartment directly below a porthole and accessible through the porthole opening, overcoming the foregoing and other shortcomings of the prior art.

More particularly, it is an object of the present invention to enable the diameter of the within inventive porthole-supported storage bag to be adjusted in a facilitated manner to the diameter of the porthole opening without presenting any impediment to threadably engaging a cover over the porthole, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 4:
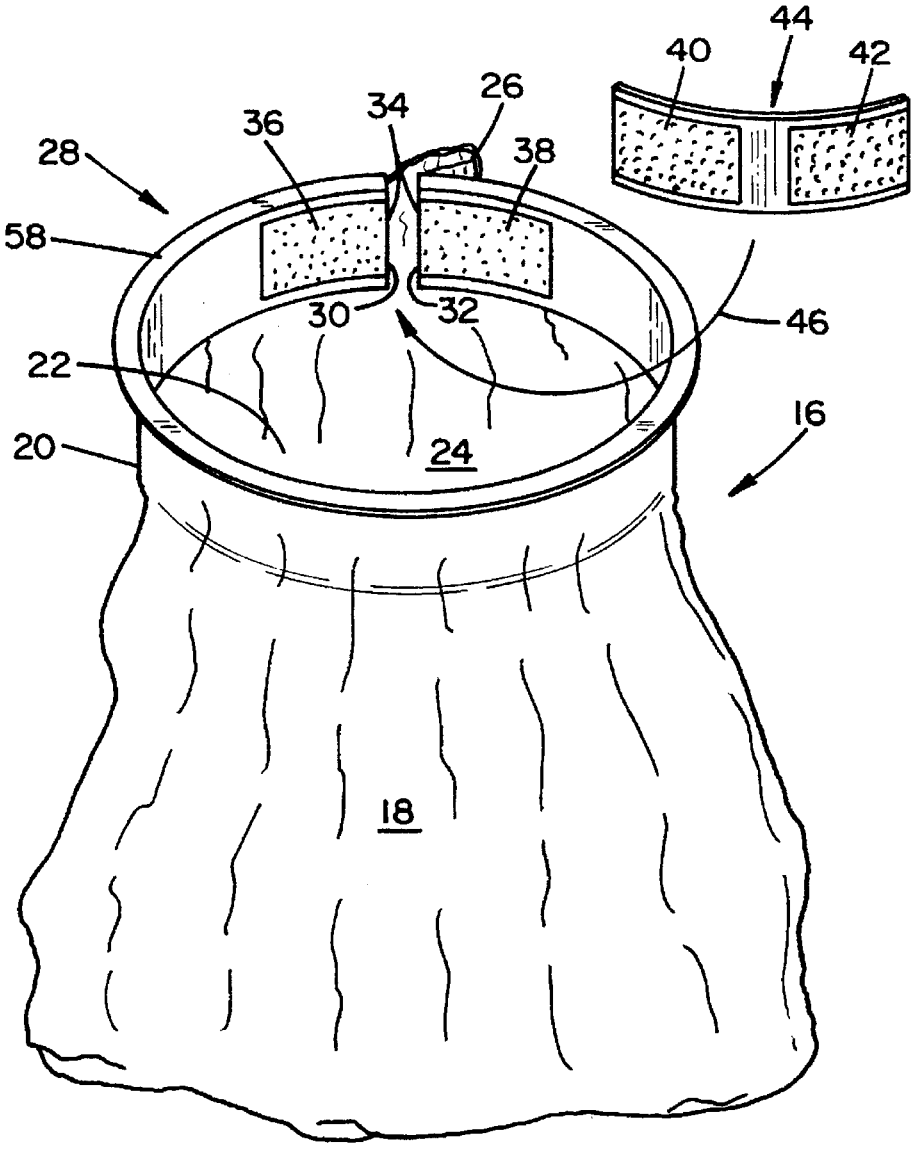
FIG. 4 is an isolated perspective view, omitting the porthole, to better illustrate the storage bag and the within inventive diameter-adjusting means embodied by the storage bag.

In sailboats in particular, space for the storage of sailing gear, clothing or the like is at a premium, and it is thus found advantageous to adapt a selected porthole 10 in the deck 12 of the boat for the additional function beyond providing light and ventilation through a porthole opening 14 for supporting in depending relation from the porthole 10 a storage bag 16 of a type configurated into a bag shape from plastic construction material 18 having, as best understood from FIG. 4, an upper edge 20 bounding an opening 22 into a bag storage compartment 24.

Typically, however, the porthole opening 14 diameter and the storage bag opening 22 diameter are either undersized or oversized in relation to each other and this complicates the seating of the storage bag 16 in the porthole opening 14. To obviate this complication, the diameter of bag opening 22 is intentionally selected to be greater than the usual diameter of the porthole opening 14 such that in relation to said usual porthole opening diameter the bag opening-bounding edge has an excess-size fold 26. Adhesively secured externally of the bag opening-bounding upper edge 20 is a flexible plastic rim 28 which will be understood to be configurated from a strip with opposite ends 30 and 32 into, as shown in FIG. 4, a circular shape in which the opposite ends 30 and 32 are in facing relation and in positions bounding a nominal clearance 34 therebetween. Patches 36 and 38 of fastener loops are adhesively or otherwise secured internally of the rim 28 adjacent the ends 30 and 32, and cooperating therewith are fastener hooks on patches 40 and 42 adhesively or otherwise secured to a diameter size-adjusting strip 44. Attachment of the patches 40 and 42 on the strip 44 to the patches 36 and 38 on the rim 28, applied from internally of the bag opening as depicted by the movement arrow 46, effectively holds the rim 28 to a diameter consisting of the circumferential size of the rim and the clearance 34, the latter being of a variable extent depending on how much of the excess-size fold 26 is taken up or payed out in the diameter sizing procedure.

Preferable to matching the diameters of the porthole opening 14 and the bag opening 22 by respective measurements, advantageous use is made of cooperating structural features of the porthole and storage bag to automatically match these diameters, all as will now be explained. The construction of the porthole 10 includes a vertically oriented wall 48 bounding the porthole opening 14 and having at its upper end a laterally outwardly extending flange 50 with circumferentially spaced openings 52 for receiving therein screws 54 for connecting the housing of the porthole 10 to the deck 12. At its opposite end, wall 48 has an inwardly extending flange 56 upon which an outwardly extending mounting flange 58 of the rim 28 is adapted to be seated. In between the flanges 50 and 56, wall 48 has integrally embodied partial in this instance, but otherwise full, threads 60 adapted to threadably engage with external threads 62 of a porthole cover 64.

Figure 1:
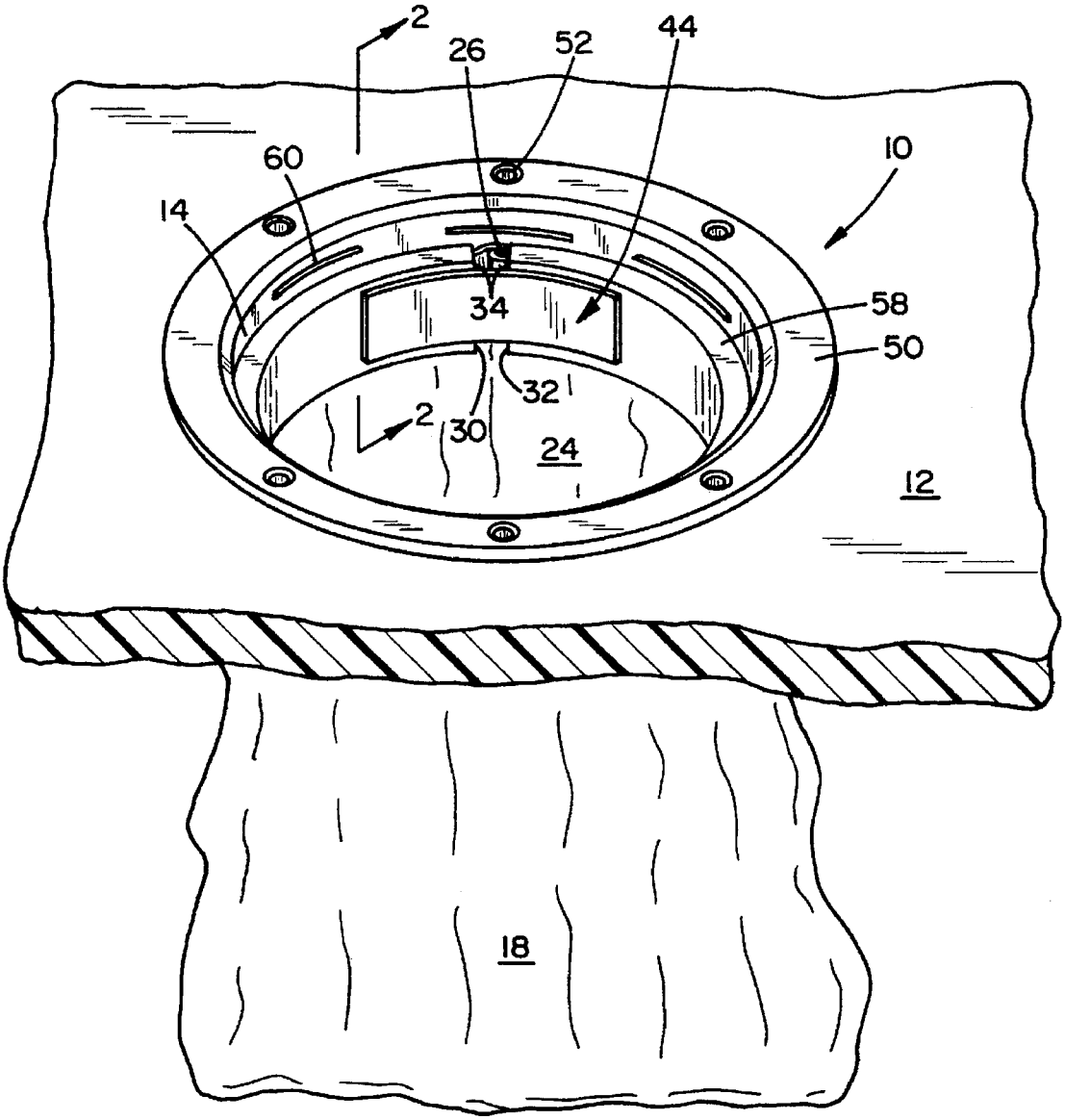
FIG. 1 is an isolated perspective view of the within inventive storage bag supported in depending relation from a boat porthole.
Figure 2:
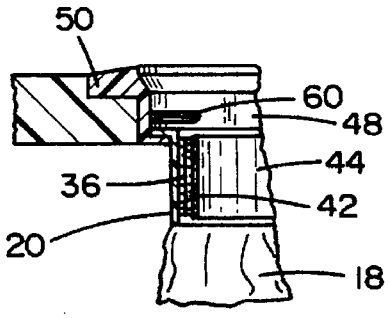
FIG. 2 is a partial side elevational view in section taken along lines 2—2 of FIG. 1 showing details of the porthole structure providing the support for the storage bag.
Figure 3:
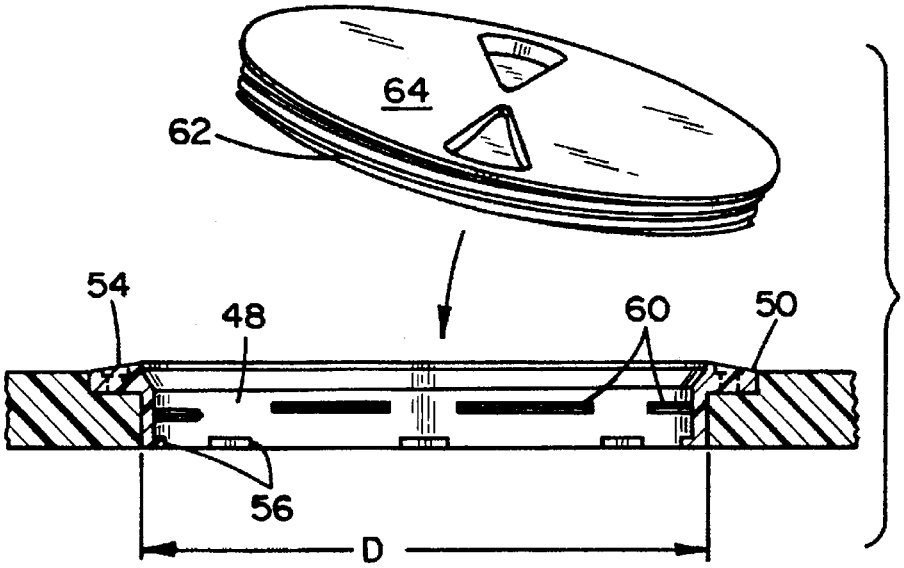
FIG. 3 is a sectional and perspective view, omitting the storage bag, to better illustrate structural details of the porthole and its cooperating cover.

The supporting of the storage bag 16 from, and within the porthole opening 14, contemplates placement of the bag and its rim 28 within the porthole opening 14 with the rim ends 30 and 32 unattached. Manually, the mounting flange 58 is positioned in covering relation over the bag-supporting flange 56, with any excess in size manifested in a fold 26 which is folded against the exterior of the rim 28. The diameters of the porthole opening 14 and of the bag opening 22 are in this manner matched to each other. The matching bag opening 22 diameter is next held to its size by the internal application, via the positioning movement 46, of the strip connecting patches 40 and 42 to rim cooperating connecting patches 36 and 38. As best understood from FIG. 1, the storage or all-purpose bag 16 is positioned for the end use intended and, as best understood from FIG. 2, there is no interference by the supported storage bag 16 with closing the porthole opening by threadably engaging the cover 64 to the unobstructed porthole threads 60.

While the boat all-purpose storage bag herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A boat all-purpose storage bag advantageously positioned in a porthole opening having a prescribed diameter as determined by an area bounded by a vertically oriented wall of a porthole body and adapted to have disposed in covering relation thereover a threadably interconnecting porthole cover, said boat all-purpose storage bag comprising plastic construction material configurated into a bag with an upper edge bounding an opening into a storage compartment, a flexible plastic rim configurated from a strip with opposite ends into a circular shape disposed in attached relation about said bag opening with said rim opposite ends in facing relation to each other and in nominal clearance positions from each other, an outwardly extending mounting flange on an upper edge of said rim adapted to seat upon an inwardly extending flange of said porthole body vertically oriented wall incident to positioning said attached bag in depending relation within said porthole opening, and a diameter size-adjusting strip disposed from within said porthole opening upon said rim in selected positions across said rim opposite ends to take up selected extents of said clearance therebetween, whereby said diameter size of said rim is effectively matched to said prescribed diameter of said porthole opening without obstruction to said threaded engagement of said porthole cover over said porthole opening.

2. The boat all-purpose storage bag as claimed in claim 1 wherein said diameter size-adjusting strip and length portions adjacent said rim opposite ends have cooperating interconnecting hook and loop means for achieving said selected positions of said diameter size-adjusting strip upon said rim.

* * * * *